United States Patent [19]

Harris

[11] Patent Number: 4,539,894

[45] Date of Patent: Sep. 10, 1985

[54] SINGLE ACTING STEAM ENGINE

[76] Inventor: Marion K. Harris, 4755 Dolores Ave., Atascadero, Calif. 93422

[21] Appl. No.: 599,790

[22] Filed: Apr. 13, 1984

Related U.S. Application Data

[60] Continuation-in-part of Ser. No. 349,204, Feb. 17, 1982, abandoned, which is a continuation-in-part of Ser. No. 208,243, Nov. 11, 1980, abandoned, which is a division of Ser. No. 44,865, Jun. 4, 1979, Pat. No. 4,262,579.

[51] Int. Cl.[3] ..... F01B 9/00

[52] U.S. Cl. ..... 92/138; 91/480; 91/502

[58] Field of Search ..... 91/502, 480, 507; 92/138, 129

[56] References Cited

U.S. PATENT DOCUMENTS

| | | | |
|---|---|---|---|
| 1,613,116 | 9/1924 | Michell | 123/51 BA |
| 1,695,543 | 12/1928 | Eisenhauer | 417/271 |
| 2,027,076 | 1/1936 | Volliman | 417/265 |
| 2,070,880 | 2/1937 | Blum | 91/502 |
| 2,386,675 | 10/1945 | Ford | 417/269 |
| 2,434,747 | 1/1948 | Ruben | 91/502 |
| 2,980,077 | 4/1961 | Magill | 91/488 |
| 3,050,005 | 8/1962 | Pschunder | 91/480 |
| 3,105,415 | 10/1963 | DeMuth | 91/480 |
| 3,370,510 | 2/1968 | Bunyan | 74/60 |
| 3,397,619 | 8/1968 | Sturtevant | 91/402 |
| 3,572,215 | 3/1971 | Harris | 91/480 |
| 4,111,102 | 9/1978 | Harris | 91/480 |
| 4,167,894 | 8/1979 | Harris | 91/480 |
| 4,262,579 | 4/1981 | Harris | 91/480 |

FOREIGN PATENT DOCUMENTS

| | | |
|---|---|---|
| 1022570 | 3/1953 | France . |
| 220551 | 8/1924 | United Kingdom . |

*Primary Examiner*—Paul E. Maslousky

*Attorney, Agent, or Firm*—Jack M. Wiseman

[57] ABSTRACT

A single acting steam engine wherein means are provided for auxiliary exhaust through the piston when an auxiliary exhaust poppet valve is open and the auxiliary exchange passages of the piston register with exhaust ports in the cylinder wall. The opening and closing of the auxiliary exhaust poppet valve are responsive to the rate of reciprocation of the pistons. A multiple of said engines may be utilized in combination to provide a multiple cylinder power plant. The engines drive a swash plate, which is formed with recessed, annular thrust surfaces. Projecting at right angles from the recessed, thrust surfaces are exhaust cams that engage valve stems through cam followers for actuating the same. The valve stems actuate the exhaust valves. The throat thickness of the swash plate between the recessed annular thrust surfaces is of uniform dimension along the circumferential paths thereof. The recessed, annular thrust surfaces have their axes coincident with the axis of rotation of the swash plate so that the radial components thereof are at right angles to the axis of rotation of the swash plate.

5 Claims, 6 Drawing Figures

SINGLE ACTING STEAM ENGINE

RELATED CASES

This application is a continuation-in-part of my copending application Ser. No. 349,204 filed Feb. 17, 1982, now abandoned, which is a continuation-in-part of application Ser. No. 06/208,243 filed Nov. 11, 1980, now abandoned, which is a division of Ser. No. 06/044,865 filed June 4, 1979, for Single Acting Steam Engine, now U.S. Pat. No. 4,262,579.

BACKGROUND OF THE INVENTION

The present invention relates in general to a steam engine, and more particularly to an improved single acting uni-flow swash plate steam engine.

At present several mechanisms make use of a swash plate to transmit the thrust of a longitudinally reciprocating member, such as a power-driven piston, to a rotary drive shaft or to impart movement to a reciprocating member. It is evident that the transfer of power between the end face of the reciprocating member and the face of the swash plate, which is moving in a plane that is transverse to the direction of movement of the reciprocating member, is an action that is critical to the efficient operation of the machine. Many arrangements for carrying-out this action have been proposed. Rollers are operatively connected between the surface of the swash plate and the reciprocating members in the devices disclosed in the patents to Volliman, Pat. No. 2,027,076; Blum, Pat. No. 2,070,880; Ford, Pat. No. 2,386, 675; and in the French Pat. No. 1.022.570 to Gaston Ladousse. Spherical members are used in the mechanisms of Magill, Pat. No. 2,980,077 and of the British Pat. No. 220,551 to Westad. Other arrangements are disclosed in the patents to Harris, Pat. Nos. 3,572,215, 4,111,102 and 4,167,894.

Applicant has found that impulses can be transmitted between the two members when a thrust element is disposed between the two members that has a simple rocking action in one plane. This rocking action permits the thrust member to have contact with the reciprocating member over a relatively large area whereas several of prior art devices make contact only along a line and, in some cases, they make point contact. It is therefore an object of the present invention to provide an improved, power transmission mechanism for a wobble-plate engine or the like, and more particularly to provide a mechanism that employs a thrust member that operates in a single plane with a simple rocking motion.

Another object is to provide a drive mechanism which makes possible a compound engine in which aligned cylinders are rigidly connected together and a single swash plate of uniform thickness actuates the pistons in the cylinders.

SUMMARY OF THE INVENTION

The present invention provides an improved single acting steam engine adaptable for powering automobiles and other vehicles, and more particularly concerns an improved mechanism for transmitting the thrust of the lateral forces of a wobble-plate to longitudinally reciprocating members.

In an exemplary embodiment of a single acting steam engine of the present invention, there is provided a compound engine. Each cylinder includes auxiliary exhaust occurring from within the cylinder chamber through the piston head when an auxiliary exhaust poppet valve carried by the head is open and the auxiliary exhaust passage integral within the piston head registers with an exhaust port leading from the cylinder chamber walls to the exterior. The auxiliary exhaust poppet valve is driven to serve as a slow closing valve to control the degree of opening near the end of the auxiliary exhaust passage during the exhaust step of the vapor cycle to produce wire drawing and effecting early closing at high engine r.p.m. rates. This results in raising terminal compression pressure acting on the piston at the end of the compression stroke and cushions inertia loads at high speed. As the piston speed decreases, wire drawing decreases such that at low speed wire drawing is not as effective. This, in turn, provides a later effective closing of the exhaust poppet valve with no change in mechanical valve timing, while reducing terminal compression pressures. Thus, at low speeds and on a short cut-off, a smooth running engine is realized. The auxiliary exhaust valve responds to push rods joined thereto. The push rods respond to a cam formed on the thrust face of the output driven member, which member, in turn, is responsive to the piston rod joining the piston. Thus, the exhaust valve control is a function of the output drive and piston speed.

In an exemplary compound steam engine embodiment, there is provided a pair of complementary cylinders. The pistons of the cylinders drive a power conversion means for converting the reciprocating motion of the pistons to rotary motion. The conversion means are illustrated in the form of a single acting swash plate driving an output drive member, e.g., a drive shaft. The piston rods are extended with a longitudinal control aperture incorporated within the piston rods and joined to a crosshead coupled to a swash plate and to cam followers responsive to a cam surface on the swash plate thrust face. The torsioned thrust face of the swash plate is straddled by the cylindrical crossheads for converting the reciprocating motion of the pistons to rotational motion to the output member. The swash plate tends to serve as a cam with one piston rod being pushed by the plate, while the other pushes on the plate itself. Thus, as the pistons and the crossheads reciprocate, the swash plate and the output drive shaft rotate. Simultaneously, the cam surface and cam follower respond to rotation of the swash plate to control the opening and the closing of the auxiliary exhaust valves, which are carried by the piston head that are responsive to the engine speed. Thus, the auxiliary exhaust port opening and closing is a function of both the piston speed and piston position within the cylinder chamber. Proper choice of materials, tolerances and running clearances provide assurance that side scuff loads to the piston rods and pistons will be absorbed by the crossheads. The pistons themselves need not contact the cylinder walls. The piston ring material may be a self-lubricating material minimizing cylinder lubrication problems at high steam temperatures The swash plate may engage a plurality of individual engines to provide a multiple cylinder power plant.

The swash plate is formed with recessed, annular thrust surfaces which have projecting at right angles thereto oppositely directed ribbon cams. The ribbon cams engage the push rods through cam followers for actuating the same to control the opening of the auxiliary exhaust valves. It is a feature of the present invention that (1) the throat thickness of the swash plate between the recessed, annular thrust surfaces is of uniform dimension about the circumferential path thereof; and that (2) the recessed annular thrust surfaces have their axes coincident with the axis of rotation of the swash plate; and that (3) the radial components of the annular thrust surfaces are at right angles to the axis of rotation of the swash plate; and that (4) the thrust block (55) between the confronting ends of the yoke abutments and the thrust face of the swash plate, as the thrust block rocks with the changing angularity of the annular thrust surfaces, rotates about a center lying within the throat of the swash plate.

By virtue of the above arrangement, in all its features, the arms of the yokes on the confronting ends of the abutments can be of fixed length and can be of rigid construction, and the swash plate does not tend to bird between the opposed, rigidly supported thrust bearings.

DESCRIPTION OF A PREFERRED EMBODIMENT

Figure 1:
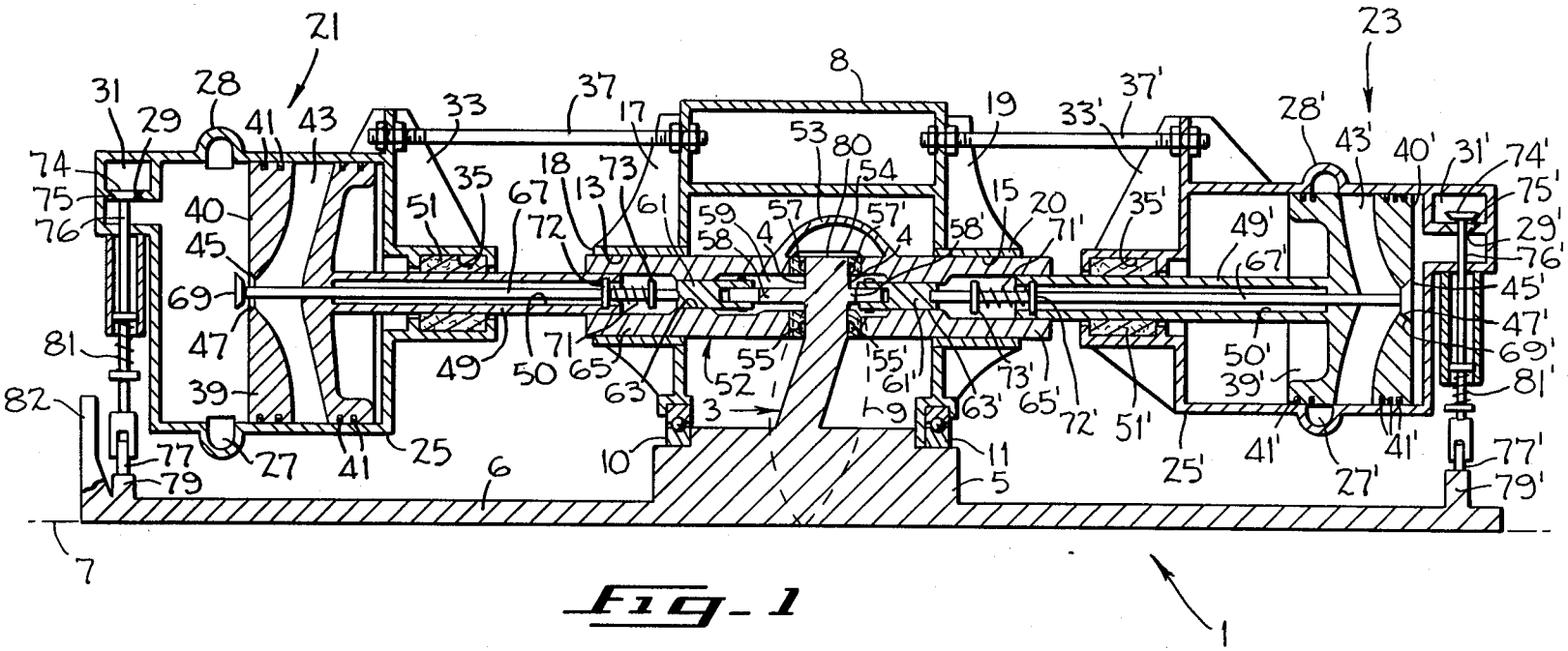
FIG. 1 is a cross-sectional view of a dual piston, single-acting-swash-plate steam engine embodying the present invention.
Figure 3:
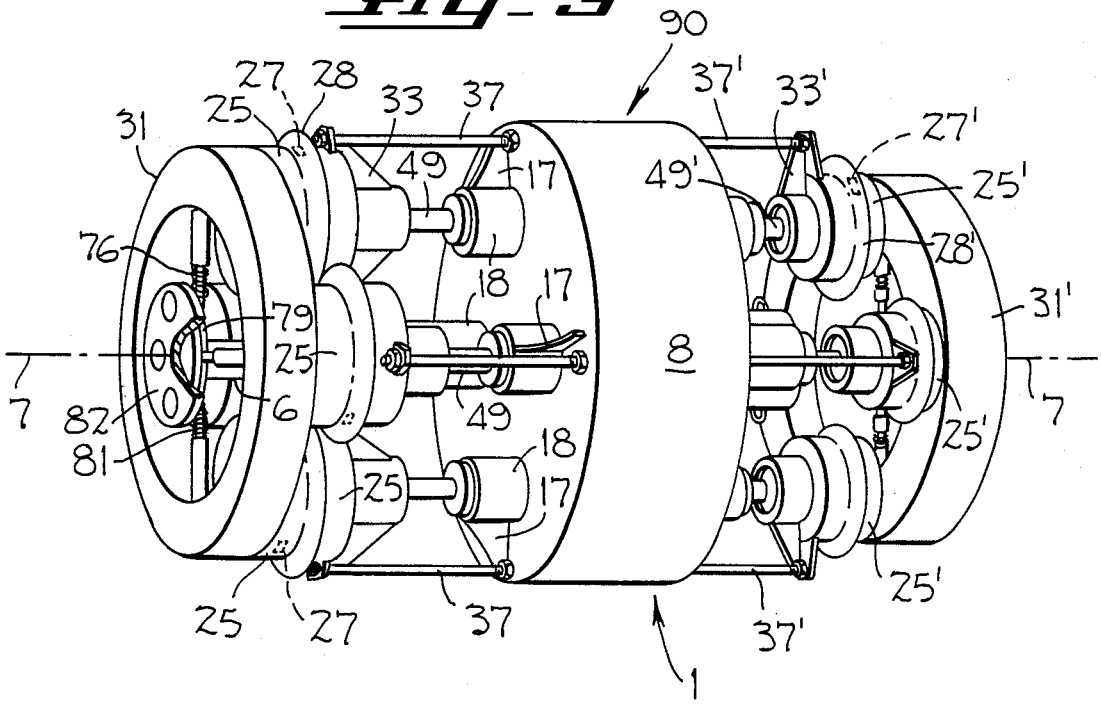
FIG. 3 is a perspective view of a multiple cylinder power plant incorporating a plurality of steam engines of FIG. 1.

FIG. 1 illustrates a cross-sectional view of a compound (dual-piston), single-acting-swash-plate steam engine embodying the present invention and is referred to by the general reference character 1. To convert the reciprocal motion of the pistons to rotary motion, there is included a rotatable swash plate 3 having outer torsioned thrust surfaces 4, and a cylindrical hub 5 serving as a cam driving member for driving a revolvable drive member in the form of a revolvable output drive shaft 6. FIG. 1 illustrates a cross-sectional view taken at the center of the swash plate 3 and the outer shaft 6. The plate 3 and shaft 6 revolve about a common axis 7 (FIG. 3). Although the plate 3 and output shaft 6 are illustrated as a unitary member, it is to be understood that the plate and shaft may take other forms including individual segments coupled through gears for translating the rotational drive of the plate to the shaft. The swash plate 3 is secured within a swash plate casing 8. The casing 8 is adapted to accommodate the reciprocal action of the swash plate 3 resulting from the torsioned surfaces 4 of the plate and the "figure-eight" path the outer periphery of the surface takes. (See the broken line 9 illustrating one-half of a path illustrative of all points on the outer periphery of one of the surfaces 4. Points on the other surface 4 assume a similar path.) A pair of combination radial and thrust bearings 10 and 11 are intermediate the hub segment 5 and the case 8 to provide rotary support for the hub 5 and to minimize or eliminate the reciprocal motion from being translated to the output shaft 6. The casing 8 has a pair of central apertures 13 and 15 extending through opposite ends. The casing 8 supports a first support 17 having a central aperture coaxial with the aperture 13 and carrying a cylindrical guide 18 and a second mounting support 19 having a central aperture coaxial with the aperture 15 and carrying a cylindrical guide 20.

The compound engine 1 includes about opposite ends of the swash plate casing 8 a pair of cylinders referred to in general by the general reference characters 21 and 23, respectively. The cylinders 21 and 23 are remotely located relative to the swash plate 3, thereby permitting substantial isolation of the plate 3 from high temperature steam operating within the cylinders 21 and 23. The cylinders 21 and 23 are of similar operation and structure except that the cylinder 21 is designed for low pressure relative to that of the cylinder 23 as illustrated by the differing cross-sectional areas. To facilitate the explanation, the common elements of the two cylinders 21 and 23 carry common reference numerals with the numerals of the cylinder 23 primed. The cylinder 21 includes a cylinder chamber casing 25 having a plurality of exhaust ports 27 extending through a longitudinal interior wall surface of the cylinder chamber to an exhaust jacket 28 that surrounds the outer periphery of the casing 25. An inlet port 29 within the chamber casing 25 extends to a steam source in the form of a steam chest 31 so as to permit entrance of steam adjacent to the interior of the bottom wall surface of the cylinder chamber 25. The inlet-exhaust arrangement provides for a uni-flow arrangement in which the steam flows through the interior of cylinder chamber 25 in one direction only, namely: in the port 29 and out the port 27. The exterior or outer wall surface of the cylinder chamber casing 25 is secured to a rib mount 33 having a central aperture 35 coaxial with the axis of the chamber casing 25 and with the aperture 13 of the casing 8. A distance support rod 37 engages the rib mounts 33, the chamber casing 25 and the mounting support 17 to provide physical support between the cylinder chamber casing 25 and the swash plate casing 8.

Within the cylinder chamber casing 25 is a piston head 39 adapted for reciprocating movement within the chamber casing 25. The piston 39 has a working surface 40 which is the only surface contacted by the uni-flow steam. The piston head 39 has a circumference sightly less than the internal circumference of the cylinder chamber casing 25. The piston 39 carries a plurality of sealing rings 41 about its periphery to provide a steam seal intermediate the piston and chamber walls. The sealing rings 41 are preferably comprised of a graphite compound material for self-lubricating between the ring and chamber casing wall surfaces. Within the piston head 39 there is an auxiliary steam exhaust passage 43. The passage 43 is common to a central auxiliary port 45 opening at the working surface 40 and extends through the longitudinal wall surface of the piston 39. The head 39 is machined about the port 45 to form a valve seat 47. Accordingly, steam within the cylinder chamber 25 passes out through the exhaust port 27 as the port 27 is uncovered by the piston 39 or as the port 27 opens to the auxiliary passage 43 while the port 45 is open.

Figure 4:
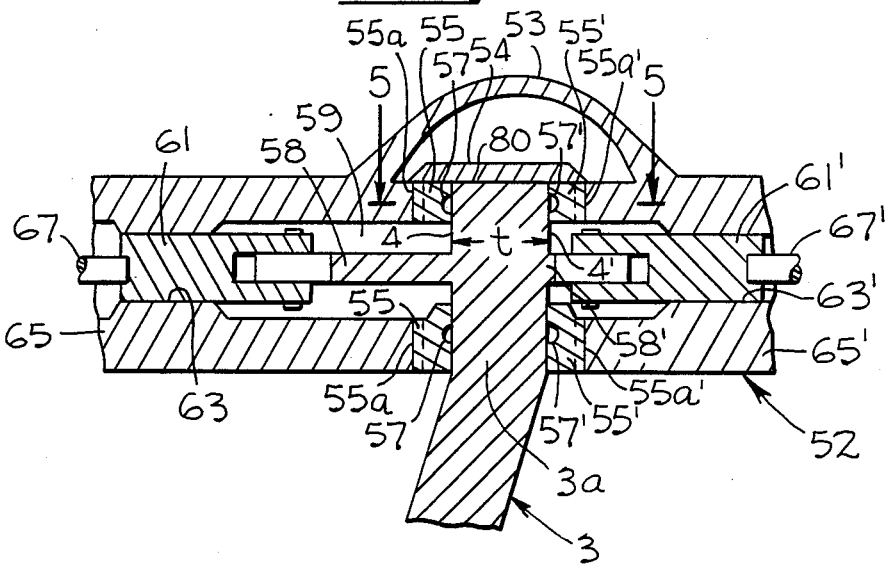
FIG. 4 is an enlarged view of a portion of the steam engine shown in FIG. 1.
Figure 5:
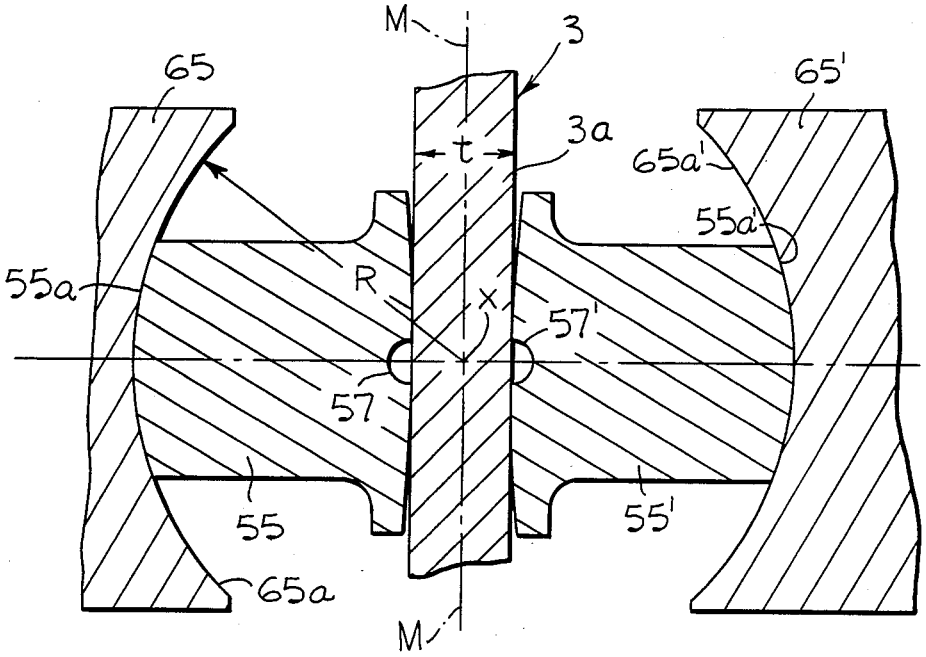
FIG. 5 is an enlarged fragmentary diagrammatic section taken along line 5—5 of FIG. 4.
Figure 6:
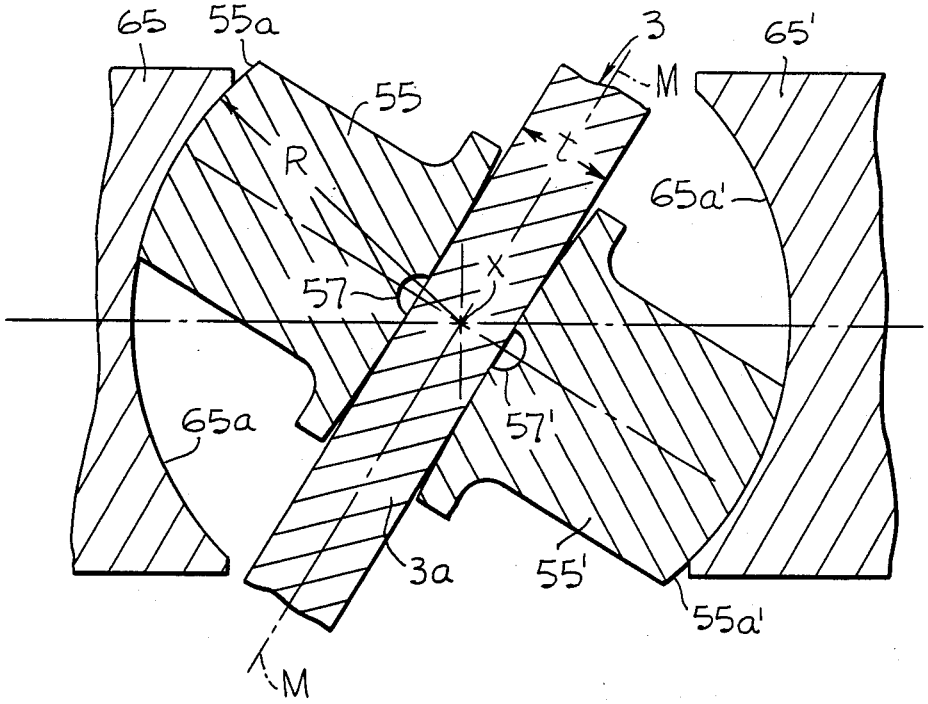
FIG. 6 is an enlarged fragmentary section similar to FIG. 5, but showing the rocking movement of the thrust member after the wobble plate has rotated about 90°.

Joined to the piston 39 is a reciprocating piston rod 49, which provides reciprocal motion in response to the reciprocating motion of the piston head 39 within the chamber of the cylinder 25. The piston rod 49 has a longitudinal central cavity 50 and extends through the aperture 35 of the rib mount 33 and through the aperture 13 of the mounting support 17 joining the swash plate casing 8. Intermediate the aperture 35 and the rod 49 is provided a packing gland 51 to provide a hermetic seal to preclude steam leakage from within the chamber of the casing 25. Within the swash plate casing 8, the piston rods 49 and 49′ are coupled in common by a crosshead or an actuating member 52 having a crosshead yoke member 53. The yoke member 53 carries a coupling member 54 that engages the outer peripheral edge of the torsioned surfaces 4 of the swash plate 3 to control rotational alignment of the reciprocating members in their bores. The yoke member 53 also engages the thrust surfaces 4 of the swash plate 3 through a set of four thrust members 55, each extending part way around the thrust surfaces 4 as seen in FIG. 5. Each of the members 55 in the exemplary embodiment has a localized thrust-bearing hydrodynamic pocket 57 which is supplied with lubricant from a suitable high pressure pump, not shown. As seen in FIGS. 5 and 6, each thrust member 55 has a segmental cylindrical outer surface 55*a* that is formed on a radius R around an axis X that is within the throat 3*a* (FIGS. 4–6) of the swash plate 3. In the preferred embodiment, the axis X of the radius R is located equidistant from or midway between the thrust faces of the throat along the centerline M (FIGS. 5 and 6). Each of the surfaces 55*a* engages a mating surface 65*a* in an end surface of a cylindrical segment 65 or 65′ of the crosshead 52.

The swash plate 3 further carries auxiliary exhaust cams 58 and 58′ of varying dimensions with each extending around one of the thrust surfaces 4. Aligned with the cams 58 and 58′ is a cavity 59 within which are positioned a pair of cam followers 61 and 61′0 that are adapted to follow the cams 58 and 58′, respectively. The cam followers 61 and 61′, respectively, protrude through apertures 63 and 63′, which are formed within cylindrical crosshead segments 65 and 65′ of the cross head 52. Cylindrical knuckle joint surfaces 55*a* are formed in the crosshead segments 65 and 65′ in the vicinity of thrust members 55, to enable the two to rock and accommodate changes of angularity of the thrust surfaces 4. The cylindrical crosshead segments 65 and 65′ secure the crosshead 52 to the rods 49 and 49′ by a pressure fit. Consequently, there is a unitary integral engagement and the crosshead 52 slides reciprocally within the guides 18 and 20. The tolerances of the segments 65 and 65′ and the guides 18 and 20 are preferably selected to minimize lateral thrust of the crosshead 52 and the rods 49. As shown, the crosshead 52 is a unitary structure to impart the reciprocal motion to the thrust surfaces 4 of the swash plate 3. The swash plate 3 responds by rotating about the central axis 7. The cam followers 61 and 61′ also, respectively, engage one longitudinal end of stems 67 and 67′ of auxiliary exhaust valves 69 and 69′. The valves 69 and 69′ are adapted to control, respectively, the opening of the ports 45 and 45′ and to seat, respectively, within the seats 47 and 47′. A pair of bias spring members 71 and 71′ engage the valve stems 67 and 67′, respectively. The springs 71 and 71′, respectively, extend between first stops 72 and 72′ supported by the rods 49 and 49′, respectively, and second stops 73 and 73′ secured to the stems 67 and 67′, respectively. The bias springs 71 and 71′, respectively, tend to bias the valves 69 and 69′ to the closed positions. As the swash plate 3 rotates and generates reciprocal motion due to the torsioned thrust surfaces 4 following the path 9, the cams 58 and 58′ act through the cam followers 61 and 61′ to control the position of the valves 69 and 69′ relative to their respective valve ports 45 and 45′. Simultaneously, rotation of the swash plate 3 is dependent upon the position of the pistons 39 and 39′ within the cylinder chamber casings 25 and 25′. The pistons 39 and 39′ are complementary such that the directions of their strokes are opposite relative to each other. Thus, when one is pushing tn the swash plate 3, the other is being pushed by the swash plate 3.

The swash plate 3 is formed with an annular rim 80. Radially inward from the rim 80, the swash plate 3 is formed with oppositely directed, recessed, annular thrust surfaces 4. The thrust surfaces 4 are at right angles to the annular rim 80. Projecting from the recessed, annular thrust surfaces 4 at right angles thereto are the oppositely directed cams 58 and 58′, respectively. The throat thickness "t" (FIG. 4) of the swash plate 3 between the circumferential paths of the recessed, annular thrust surfaces 4 is of uniform dimension along said circumferential paths. The thrust members 55 are sufficiently separated to permit the exhaust cams 58 and 58′ to move freely therebetween. With the throat thickness "t" of uniform dimension along the circumferential paths of the thrust surfaces 4, the swash plate 3 does not tend to bind between the opposed rigidly supported thrust members 55. The thrust members 55, in the preferred embodiment, would be slightly of convex curvature in a circumferential direction. The convex curvature of the thrust shoe would be slightly greater than is required to clear any moderate localized concavity of the thrust face. The additional curvature would serve to allow the thrust shoe to ride along the oil film on the advancing thrust face of the swash plate 3 to promote improved lubrication between the bearing surfaces.

The radial components of the thrust surfaces 4 are at right angles to the axis of rotation of the swash plate 3. The throat thickness "t" between thrust surfaces 4 is of uniform dimension around the full perimeter of the thrust surfaces.

The steam inlets to the chamber casings 25 and 25′ are controlled by inlet valves 74 and 74′, which are adapted to seat within seats 75 and 75′, respectively, formed about the apertures 29 and 29′. The valve 74 carries a valve stem 76, which engages about its other terminal end a cam follower 77. In turn, the cam follower 77 engages an inlet cam 79 carried by the output drive shaft 6. Surrounding the stem 76 intermediate the cam follower 77 and the valve 74 is a bias spring arrangement 81 which is adapted to bias the valve 74 in a closed position relative to the inlet port 29. Thus, the inlet steam supply from the steam chest 31 is regulated in response to the output shaft 6. The output shaft 6 also drives a power take off disc 82. A similar arrangement is provided for the valve 74′, valve stem 76′, cam follower 77′, spring arrangement 81′, inlet port 29′, and steam chest 31′. The structure of FIG. 1 is such that wire drawing action by the auxiliary exhaust valves 69 and 69′, respectively, provide a cushioning effect for the pistons 39 and 39′ at high speeds. Briefly, the wire drawing effect results as the poppet valves 69 and 69′ approach their seat and the associated piston is on the compression stroke. As the pistons 39 and 39′, respectively, approach the top of the cylinder chamber casings 25 and 25′, the steam holding areas, respectively, within the chambers decrease. This tends to force the steam through the uncovered area of the exhaust ports 45 and 45′ at a faster rate, while the valves 69 and 69′ tend to close. Consequently, there is an increase in effective pressure within the respective chambers. The action of the exhaust valves 69 and 69′ is related to the piston speed such that at low speeds, the fluid (steam) is pushed out through the ports 45 and 45' slowly and the degree of cushioning is less. The cams 58 and 58' are selected such that it is the exhaust valves 69 and 69', closing on each cycle of their respective pistons 39 and 39', which control end of auxiliary exhaust phase, rather than departure of passages 43 and 43' from registration with fixed exhaust ports 28 and 28'.

Figure 2:
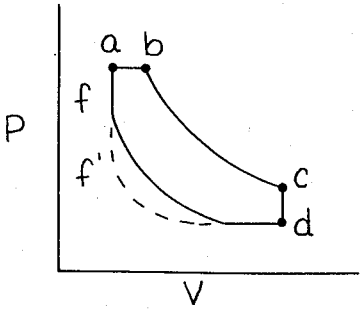
FIG. 2 illustrates a theoretical indicator diagram of the steam engine of FIG. 1.

FIG. 2 represents a diagrammatic indicator card of one cylinder of the engine of FIG. 1. The diagram illustrates the pressure (P) versus volume (V) of the cylinders and action of the exhaust valves 69 and 69' within their respective cylinders. Steam is entered through the inlet ports 29 and 29', respectively, to the cylinder chamber casings 25 and 25' during step a-b with point b representing the cut-off point at which the inlet valves 29 and 29' close. The step a-b is followed by an expansion or work step b-c. At point c, the pistons 39 and 39' uncover the uni-flow exhaust ports 27 and 27' such that there is a further decrease in pressure to point d. At point d, the pistons being to compress the fluid within the associated cylinder chambers. The speed of the piston determines the path d-a and build up of pressure. At high speeds, the auxiliary exhaust valves 69 and 69' are undergoing relatively high wire drawing and the pressure tends to build up relatively early in the exhaust stroke and builds up to a relatively high level as illustrated by the solid line d-f-a to provide cushioning. At lower speeds, the pressure builds up more gradually as illustrated by the partially broken line d-f'-a due to the fact that the exhaust valves 69 and 69' are effectively open until they get closer to their respective seats. At the low speed, compression begins later in the stroke and builds to a moderate level for smooth running. Upon reaching the point "a" the cycle is repeated.

As previously indicated, the cylinders 21 and 23 are complementary such that as rods 49 and 49' move together, whereby either the inlet valve 74 or the inlet valve 74' is open to receive steam from the respective steam chests 31 and 31'. If the valve 74' is open in response to the action of the cam 79' on the output shaft 6, steam enters the inlet port 29' to the interior of the cylinder 25'. At this point in the stroke, the auxiliary exhaust valve 69' is closed and the piston 39' is at the extreme forward part of its stroke. The expansion of the steam then applies a force on the working surface 40' of the piston 39' to cause it to "push" the piston rod 49' and swash plate 3. The auxiliary exhaust valve 69' is closed. The output shaft 6, the cams 79 and 79', and the inlet valves 74 and 74', respond as does the piston 39'. As the piston 39' moves to the rear, the main exhaust ports 27' are exposed commencing the step c-d. The piston 39 then changes direction and receives thrust from the swash plate 3 on the compression stroke. The auxiliary passages 43' within the piston 39' come into alignment with the ports 27'. Simultaneously, the cam 58' drives the cam follower 61' and the auxiliary exhaust valve 69' opens. As the piston nears the top of the compression stroke wire drawing commences as previously described, auxiliary exhaust valve 69' closes, the inlet valve 29' opens and the cycle is repeated. The cylinder 21 acts complementary to the cylinder 23 through the cycle.

As the pistons 39 and 39' reciprocate, the crossheads 52 and 52' follow. The swash plate 3 converts the reciprocal motion to a rotary motion that is imparted to the drive shaft 6. Proper choice of materials and running clearances and tolerances will ensure that all side scuff loads will be absorbed by the crossheads 52 and 52' and not imparted to any substantial degree to the rods 49 and 49'. The pistons 39 and 39' need not contact the wall of the cylinders 25 and 25', but may be isolated by the piston seal rings 41 and 41'. The material of the piston rings 41 and 41' may be of a self-lubricating graphite base material to minimize lubrication problems at high steam temperatures.

The described embodiment provides thermal isolation of the hot and cold parts of the operating engine in various ways. Utilization of the uni-flow engine type, relatively long trunk pistons 39 and 39', and mounting the hot working cylinders 21 and 23 remote from the swash plate casing 8 on the distance support rods 37 and 37' all aid in the isolation. As a result, steam condensation in the chambers of the operating cylinder can be substantially eliminated. The swash plate components also may be lubricated with conventional low temperature lubricants.

FIG. 3 illustrates diagrammatically in perspective a swash plate drive power plant referred to by the general reference character 90, incorporating four compound engines 1. The various elements common to FIG. 1 carry the same reference numerals.

The four engines 1 are evenly spaced, i.e., ninety degrees apart, so as to be equally spaced about the swash plate 3 within the casing 8. The drive shaft 6 is coaxial with the casing 8 and toroidal shaped steam chest 31 and 31'. Thus, FIG. 1 may be viewed as a radial section extending outwardly from the longitudinal centerline 7—7 of the power plant of FIG. 3. Obviously, depending on the particular application, the power plant 90 may include a select number of engines 1.

From the foregoing description and particularly referring to FIGS. 5 and 6, it will be readily apparent that the present invention provides a unique mechanism for transmitting the thrust of a reciprocating piston to the side face of a swash plate. The segmental cylindrical surfaces **65*a*–55*a* provide a substantial contact area as distinguished from the line contact of prior art rollers and the point contact of prior art spheres. Of major importance is the fact that the thrust members 55 move along an arcuate surface generated about an axis located within the throat of the swash plate 3. This unique arrangement makes it possible to have a swash plate that has a uniform thickness in the area where it passes between and engages opposed thrust members 55**.

I claim:

1. In an engine of the type that has a swash plate rotatable about an axis that is generally transverse to the plate and at least one actuating member mounted for movement in a direction that is generally parallel to the axis, said swash plate having a throat, the improvement which comprises: means defining an annular thrust surface on the throat of said swash plate extending around said axis, any radial portion of said surface being disposed at right angles to the axis; a thrust member disposed between the swash plate and the actuating member and having a force-transmitting surface any portion of which is radial to the axis, is disposed normal to the axis, and is in contact with said thrust surface; and means defining engaging rocking surfaces on said actuating member and on said thrust member to permit rocking movement of said thrust member relative to said actuating member to accommodate variations in the circumferential angularity of the thrust surface of the swash plate as it rotates, the rocking surface on said thrust member being segmented cylindrical in configuration and formed on a radius around an axis disposed within the throat of the swash plate, said thrust of said swash plate having a thrust surface oppositely directed from said thrust surface, said axis of said radius for the configuration of said segmental cylindrical surface of said thrust member being located midway between said thrust surfaces, the thickness of said throat between said thrust surfaces being of uniform dimension about the circumference thereof.

2. In a machine of the type that has a swash plate rotatable about an axis that is generally transverse to the plate and at least one actuating member mounted for movement in a direction that is generally parallel to the axis, said swash plate having a throat, the improvement which comprises: means defining an annular thrust surface on the swash plate extending around said axis, any radial portion of said surface being disposed at right angles to the axis; a thrust member disposed between the swash plate and the actuating member and having a force-transmitting surface in engagement with the annular thrust surface of the swash plate; and means defining engaging rocking surfaces on said actuating member and on said thrust member respectively to permit rocking movement of said thrust member relative to the actuating member, the rocking surface being formed on a radius around an axis disposed within the throat of the swash plate, said throat of said swash plate having a thrust surface oppositely directed from said thrust surface, said axis of said radius for the configuration of said segmental cylindrical surface of said thrust member being located midway between said thrust surfaces, the thickness of said throat between said throat surfaces being of uniform dimension about the circumference thereof.

3. In a machine as claimed in claim 2 wherein the actuating member has a fragmentary cylindrical surface and said thrust member has a fragmental cylindrical surface in engagement with the surface of said actuating member, said surfaces having substantially the same curvature.

4. In a machine as claimed in claim 2 wherein the surface of said thrust member that engages the swash plate is a convex surface and the surface of said thrust member that engages the actuating member is a fragmentary cylindrical surface.

5. In a compound engine of the type wherein a plurality of aligned pistons are mounted for simultaneous movement over a rectilinear path in each direction of the rectilinear path, an actuating member coupled to confronting ends of said pistons, said actuating member having spaced confronting portions, a swash plate mounted for rotary movement about an axis parallel to the direction of movement of said pistons and having an annular peripheral section providing oppositely directed thrust surfaces disposed between the spaced confronting portions of said actuating member, said swash plate having a throat, a thrust member disposed between each spaced confronting portion of said actuating member and a confronting thrust surface of said thrust surfaces of said swash plate, means defining a surface on one end of each thrust member in contact with the associated thrust surface of said swash plate and a segmental cylindrical surface on the other end of the thrust member, said segmental cylindrical surface being generated about an axis lying within the throat of said swash plate, and means defining a segmental cylindrical surface in each of said spaced confronting portions of said actuating member to receive the segmental cylindrical surface of the associated thrust member for rocking movement about said axis within said throat, said axis for the generation of said cylindrical surface of said thrust member being located midway between said thrust surfaces of said swash plate, the thickness of said throat between said thrust surfaces being of uniform dimension about the circumference thereof.

* * * * *